US005649893A

United States Patent [19]

Inaniwa et al.

[11] Patent Number: 5,649,893

[45] Date of Patent: Jul. 22, 1997

[54] CENTRIFUGAL APPARATUS HAVING SERIES-IMPLEMENTED PROTECTION MEANS

[75] Inventors: Masahiro Inaniwa; Shinji Watanabe; Tsutomu Takamura; Noriyasu Matsufuji; Takahiro Fujimaki, all of Hitachinaka, Japan

[73] Assignee: Hitachi Koki Co., Ltd., Japan

[21] Appl. No.: 651,245

[22] Filed: May 22, 1996

[51] Int. Cl.[6] ..... B04B 9/10; B04B 13/00

[52] U.S. Cl. ..... 494/9; 494/10

[58] Field of Search ..... 494/1, 7–12, 16, 494/84, 85

[56] References Cited

U.S. PATENT DOCUMENTS

| | | | |
|---|---|---|---|
| 4,450,391 | 5/1984 | Hara | 494/9 X |
| 4,551,715 | 11/1985 | Durbin | 494/9 X |
| 4,700,117 | 10/1987 | Giebeler et al. | 494/7 X |
| 4,827,197 | 5/1989 | Giebeler | 494/10 X |
| 5,221,250 | 6/1993 | Cheng | 494/10 X |

FOREIGN PATENT DOCUMENTS

| | | | |
|---|---|---|---|
| 321920 | 6/1989 | European Pat. Off. | 494/7 |
| 2415934 | 10/1974 | Germany | 494/9 |
| 766651 | 9/1980 | U.S.S.R. | 494/9 |
| 2240496 | 8/1991 | United Kingdom | 494/7 |
| 8700770 | 2/1987 | WIPO | 494/10 |

*Primary Examiner*—Charles E. Cooley

*Attorney, Agent, or Firm*—Parkhurst, Wendel & Burr, LLP

[57] ABSTRACT

A centrifugal protection apparatus including: a rotor having markers connected to a motor responsive to drive signals; first and second detectors for detecting the marker upon rotation of the rotor and generating first and second detection signals respectively; a drive circuit responsive to a command for generating the drive signals from the supply power via input terminal in response to the first or second detection signal; first and second switch circuits, arranged in series between the input terminal and the motor, for controlling the supply of the drive signals to the motor; a current detector for detecting a current of one of the drive signals and generating a current detection signal; and first and second judging portions for detecting whether the first and second detection signals are within a predetermined value and for operating the first and second switch circuits to cut off the drive signals when the first and second detection signals are not within the predetermined value respectively and when a magnitude of the current detection signal is larger than the predetermined value when the second detection signal is not generated. The first and second judging portions, first and second detectors, and the current detector operate in parallel and independently. The first and second switch circuits are arranged in series to provide more dependable protection.

9 Claims, 9 Drawing Sheets

CENTRIFUGAL APPARATUS HAVING SERIES-IMPLEMENTED PROTECTION MEANS

BACKGROUND OF THE INVENTION

1. Field of the Invention

This invention relates to a centrifugal apparatus for rotating a rotor with protection.

2. Description of the Prior Art

A centrifugal apparatus with protection comprising a rotor, a driving motor for rotating the rotor, a detector for detecting a rotation speed of the rotor, and a controller for protecting against overspeed running of the rotor in response to the detector is known. FIG. 9 is a bock diagram of a prior art centrifugal apparatus with protection disclosed in U.S. Pat. No. 4,903,191. An exchangeable rotor 201 is rotated by a motor 202. Rotation of the exchangeable rotor 201 is detected by a detector 204 by detecting a magnet field from a magnet fixed to the exchangeable rotor 201. A master microprocessor (mpu) 211 and a slave microprocessor 205 separately detect the rotation speed of the exchangeable rotor 201 and the kind of the exchangeable rotor 201. If either of the master microprocessor 211 or the slave microprocessor 205 detects overspeed running of the exchangeable rotor 201 in accordance with the detected kind of the exchangeable rotor, that is, either of the master microprocessor 211 or the slave microprocessor 205 detects whether the rotation speed of the exchangeable rotor 202 exceeds a maximum value determined in accordance with the detected kind of the exchangeable rotor, an overspeed protection signal is supplied to an overspeed protection switch for cutting off drive signals to the motor 202. Therefore, the overspeed running of the exchangeable rotor is protected with a feed back loop from the magnet 214, the master microprocessor 211 or the salve microprocessor 205, an OR gate 208, the switch circuit 207, and the motor 202, wherein the master microprocessor 211 and the slave microprocessor 205 are doubled with respect to feedback loops. Therefore, a runaway in the master microprocessor 211 or the slave microprocessor 205 and an erroneous operation due to a bug in a program in the master microprocessor 211 or the slave microprocessor 205 can be avoided. However, the feed back loop is single.

SUMMARY OF THE INVENTION

The aim of the present invention is to provide an improved centrifugal apparatus with protection.

According to the present invention there is provided a first centrifugal apparatus comprising: a rotor having marker portion; a motor responsive to drive signals for rotating the rotor; a first detector for detecting the marker portion upon rotation of the rotor and generating a first detection signal; a second detector for detecting the marker portion upon rotation of the rotor and generating a second detection signal; an input terminal for receiving a supply power; a drive circuit responsive to a command for generating the drive signals from the supply power in accordance with either of the first detection signal or the second detection signal; first and second switch circuits for controlling application of the drive signals to the motor, the first and second switch circuits being connected in series from the input terminal to the motor via the drive circuit; a current detector for detecting a current of one of the drive signals and generating a current detection signal; a first judging portion for detecting whether the first detection signal is within a predetermined condition and for operating the first switch circuit to cut-off the drive signals to the motor when the first detection signal is not generated within the predetermined condition; and a second judging portion, for detecting whether the second detection signal is generated within the predetermined condition, for operating the second switch circuit to cut-off the drive signals to the motor when the second detection signal is not generated within the predetermined condition, for comparing a magnitude of the current detection signal with a predetermined level, for detecting whether the second detection signal indicates that the rotor is stopped, and for operating the second switch circuit to cut-off the drive signals to the motor when the magnitude of current detection signal is larger than the predetermined level when the second detection signal indicates that the rotor is stopped.

The first centrifugal apparatus may further comprise a second current detector for detecting another one of the drive currents and supplying a second current detection signal to the first judging portion, wherein the first judging portion compares a magnitude of the second current detection signal with a second predetermined level, detects whether the first detection signal indicates that the rotor is stopped, and operates the first switch circuit to cut-off the drive signals to the motor when the magnitude of the second current detection signal greater than the predetermined level when the first detection signal indicates that the rotor is stopped, the first and second judging portion operate independently of each other, and the current detector and the second current detector operate independently of each other.

In the first centrifugal apparatus, the first and second judging portions independently detect first and second rotation speeds from the first and second detection signals respectively, the first and second judging portions independently detect whether the first rotation speed exceeds a predetermined value and whether the second rotation speed exceeds the predetermined value respectively, the first judging portion controls the first switch to cut-off the drive signals to the motor when the first rotation speed exceeds the predetermined value, and the second judging portion controls the second switch to cut-off the drive signals to the motor when the second rotation speed exceeds the predetermined value.

In the first centrifugal apparatus, the rotor is detachable from the motor and the marker portion has information indicative of rotor type, the first and second judging portions further detect the information from the first and second detection signals respectively and determine first and second maximum values in accordance with the detected information respectively, the first judging portion operates the first switch to cut-off the drive signals to the motor when the first rotation speed exceeds the first maximum value, and the second judging portions operates the second switch to cut-off the drive signals to the motor when the second rotation speed exceeds the second maximum value.

In the first centrifugal apparatus, the marker portion may comprises at least a magnet.

In the first centrifugal apparatus, the drive circuit may comprise an inverter circuit for generating phase signals and a power bridge circuit for generating the drive signal from the phase signals and the first switch circuit is provided between the input terminal and the inverter circuit. Moreover, the second switch circuit may comprise photocouplers for transmitting the phase signals to the power bridge circuit, a switch, and a power source for supplying a power to the photocouplers through the switch and the second judging portion controls the second switch circuit to cut-off the drive signals to the motor by controlling the switch when the second detection signal is not generated within the predetermined condition.

In the first centrifugal apparatus, the first and second judging portions operate independently of each other.

According to the present invention there is also provided a second centrifugal apparatus comprising: a rotor having a marker portion; a motor responsive to drive signals for rotating the rotor; a detector for detecting the marker portion with rotation of the rotor and generating a detection signal; an input terminal for receiving a supply power; a drive circuit responsive to a command for generating the drive signals from the supply power in accordance with the detection signal; a switch circuit for controlling application of the drive signals to the motor, the switch circuit being connected in series from the input terminal to the motor via the drive circuit; a current detector for detecting a current of one of the drive signals and generating a current detection signal; a magnitude detection portion for detecting a magnitude of the current detection signal, and a judging portion for detecting whether the current detection signal is generated within a predetermined level, for detecting whether the detection signal indicates that the rotor is stopped, and for operating the switch circuit to cut-off the drive signals to the motor when the current detection signal is greater than the predetermined level when the current detection signal indicates that the rotor is stopped base on the the magnitude of the current detection signal.

BRIEF DESCRIPTION OF THE DRAWINGS

The object and features of the present invention will become more readily apparent from the following detailed description taken in conjunction with the accompanying drawings in which.

The same or corresponding elements or parts are designated with like references throughout the drawings.

DETAILED DESCRIPTION OF THE INVENTION

Figure 1:
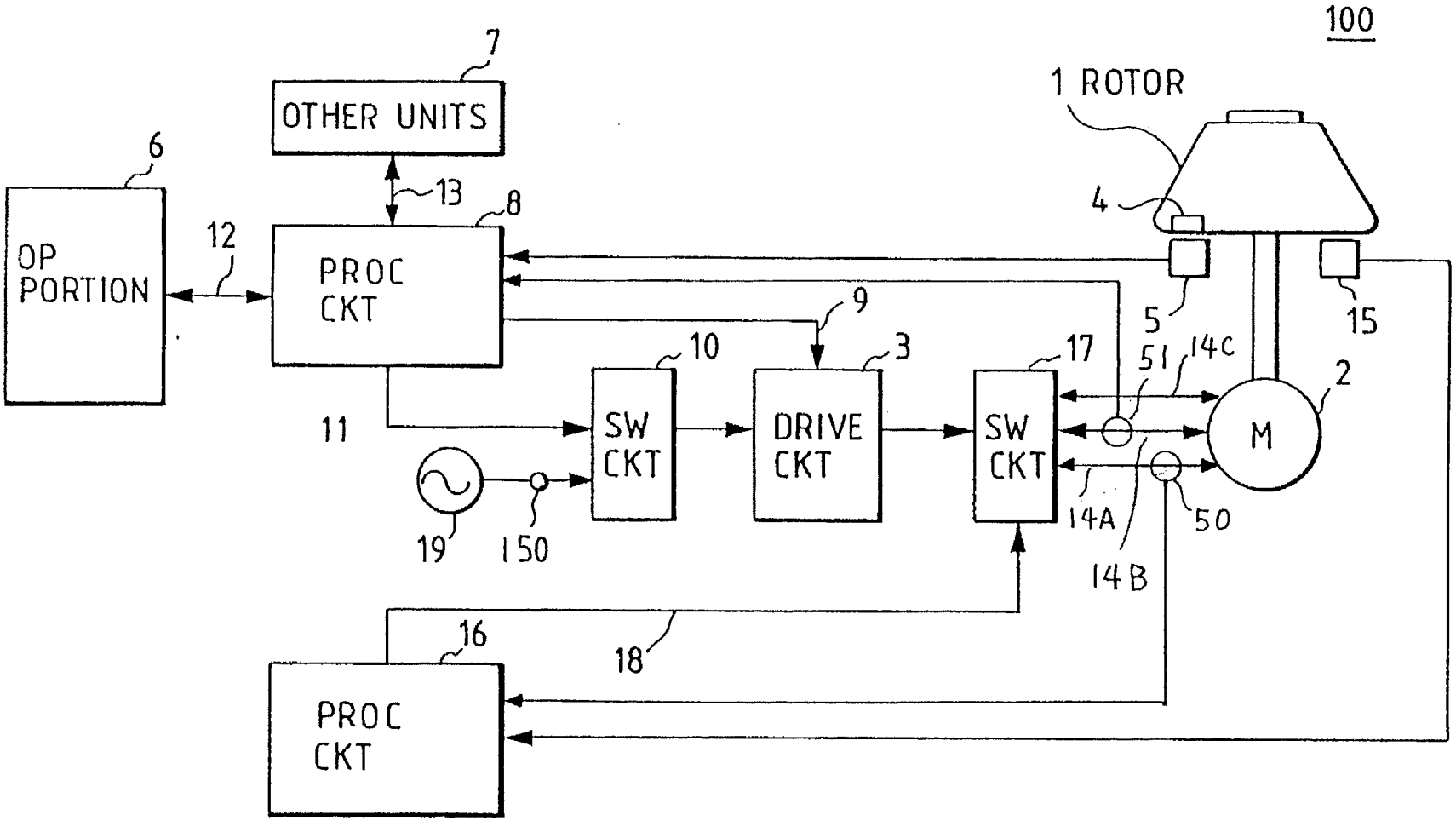
FIG. 1 is a block diagram of a centrifugal apparatus with protection of an embodiment.

Hereinbelow will be described an embodiment of the present invention. FIG. 1 is a block diagram of a centrifugal apparatus with protection of this embodiment. The centrifugal apparatus with protection of this embodiment comprises an exchangeable rotor 1, magnets 4 as markers, fixed to a bottom portion of the rotor 1, for generating magnetic fields, a first detector 5, confronting the magnets 4, for detecting the magnetic fields and generating a first detection signal as an index signal, a first processing circuit 8, including a first microprocessor (mpu) 33, for generating a rotation control signal 9 and a first protection signal 11 in accordance with the first detection signal, an operation command, and a second drive current detection signal, an operation portion 6 for supplying the operation command to the microprocessor 33 in response to an operation by an operator, a drive circuit 3 for generating drive signals from a supply power supply, a motor 2 for rotating the rotor 1 in response to the drive signals 14 supplied through drive lines 14A to 14C, a first current detector 50 for detecting the drive signal on the drive line 14A and for generating a first drive current detection signal, a second current detector 51 for detecting the drive signal on the drive line 14B and for generating the second drive current detection signal supplied to the processing circuit 8, a first switch circuit 10 for controlling application of the supply power from a power supply 19 to the drive circuit 3 in response to the first protection signal 11 from the processing circuit 8, a second detector 15 for detecting the magnetic fields and generating a second detection signal as an index signal, a second processing circuit, including a second microprocessor 16, for generating a second protection signal 18 in accordance with the second detection signal and the first drive current detection signal, a second switch circuit 17 for controlling application of drive signals 14 to the motor 2 in response to the second protection signal 18 from the second processing circuit 16, wherein the first and second processing circuits 8 and 16 detect the rotor type by analyzing detected intervals of detection of magnet fields of the magnets 4 to detect information regarding the kind of the currently set rotor 1 and determines a maximum rotation speed of the currently set rotor 1 to generate the first and second protection signals respectively.

The first and second detectors 5 and 15 comprise Hall elements which can be replaced by magneto-resistance elements or pickup coils. The processing circuit 8 also controls other units 7 such as a vacuum pump.

Each of the first and second drive current detection circuits 50 and 51 comprises a current detector including a winding or a Hall sensor (not shown) and an amplifier (not shown) for amplifying a detected current signal and a smoothing circuit (not shown) for smoothing the detected current signal from the amplifier and outputs the drive current detection signal. The drive signal detection signals from the drive signal detection circuits 50 and 51 are supplied to inputs AD1 and AD2 of the second and first microprocessors 38 and 33 for A/D converting processing included in the processing circuits 8 and 16, as shown in FIG. 2.

The rotation speed and the kind of rotor 1 is independently detected by the first and second detectors 5 and 15 and the first and second microprocessors 33 and 38. Then, protection operations are independently effected by the first switch circuit 10 controlled by the microprocessor 33 and the second switch circuit 17 controlled by the microprocessor 33 in a series manner. Thus, double feedback lines for protection are achieved, such that a degree of safety in the protection is considerably increased.

Figure 2:
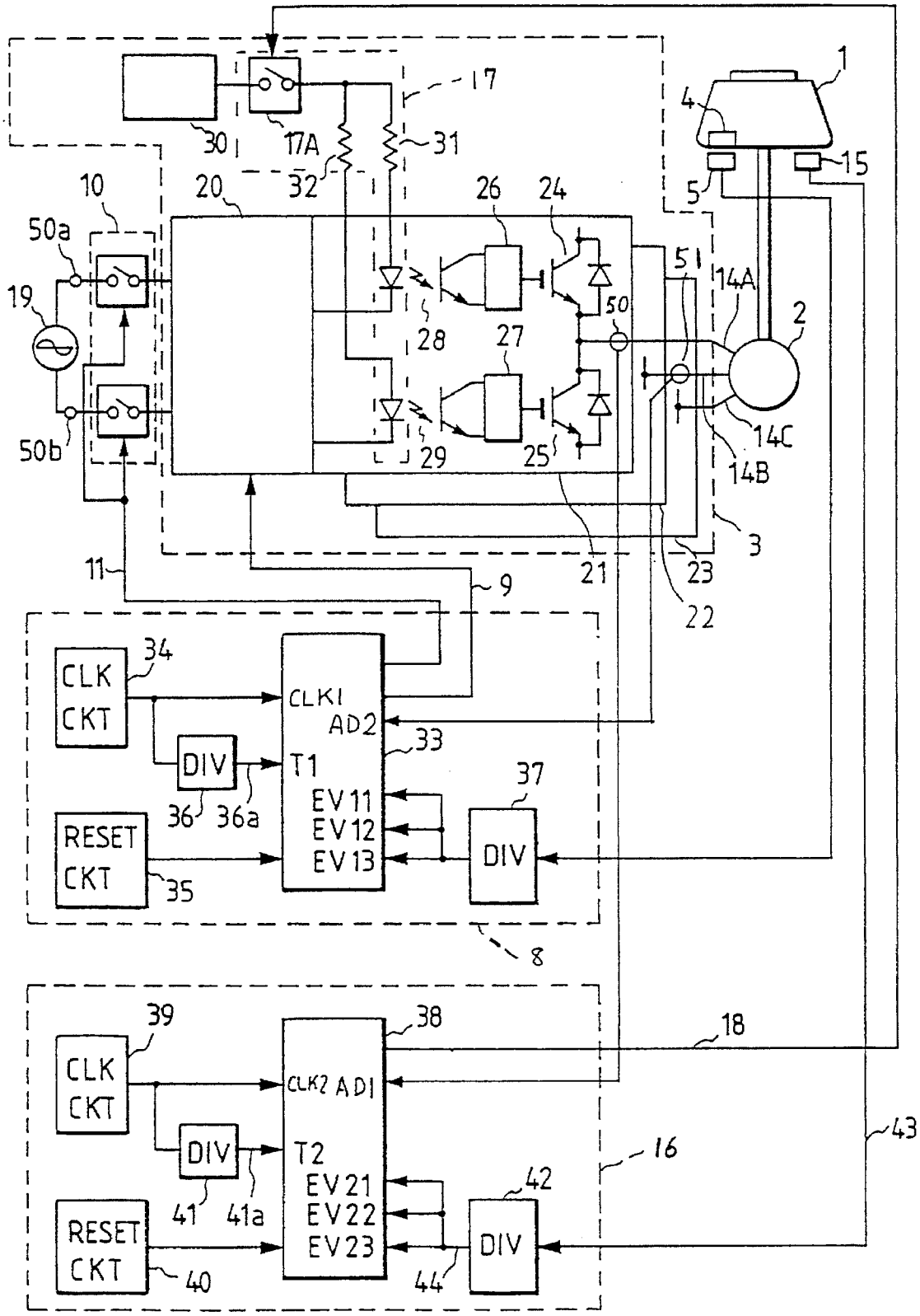
FIG. 2 is a partial detailed block diagram of the centrifugal apparatus with protection shown in FIG. 1.

FIG. 2 is a partial detailed block diagram of the centrifugal apparatus with protection shown in FIG. 1, wherein the other units 7 and the operation portion 6 are not shown. The power supply 19 supplies the supply power to the motor 2 through the switch circuit 10 and the drive circuit 3. The drive circuit 3 comprises an inverter control circuit 20 for effecting an inverting control operation, that is, generating three-phase signals, and power bridge circuits 21 to 23 for supplying three-phase drive signals 14A to 14C to the induction motor 2. Each of the power bridge circuit comprises power transistors, IGBTs (Insulated Gate Bipolar Transistors), or GTOs (gate-turn-off switch) for example. The three-phase drive signals 14A to 14C are supplied from arms of the power bridge circuits 21 to 23 to the respective windings of the motor 2. As shown, the power bridge circuit 21 comprises IGBT 24 and IGBT 25, gate control circuit 26 and 27 for controlling the IGBTs 24 and 25, photocouplers 28 and 29 for energizing the IGBT in response to one of the three-phase signals from the inverter control circuit 20. The switch circuit 17 comprises a switch 17A, photocouplers 28 and 29 supplied with a photocoupler supply power from a power supply 30 through the switch 17. Therefore, when the switch 17A is not in the protection mode pursuant to the protection signal 18, the photo-couple supply power from the power supply 30 is supplied to the photocouplers 28 and 29 through the switch 17A. Then, the inverter control circuit 20 supplies the three-phase signals to the photocouplers 28 and 29 and the three-phase drive signals are supplied to the motor 2 when the microprocessor 33 supplies the rotation control signal indicative of the rotation of the rotor 1. When the switch 17A is in the protection mode pursuant to the protection signal 18, the photocoupler supply power from the power supply 30 is not supplied to the photocouplers 28 and 29 through the switch 17A. Then, though the inverter control circuit 20 supplies the three-phase signals to the photocouplers 28, the three-phase drive signals are not generated and the rotation of the rotor 1 is protected or stopped because the photocouplers 28 and 29 are not energized.

The switch 10 comprises relays or semiconductor relays including triacs. When the switch 10 is in the protection mode pursuant to the protection signal 11, the switch 10 does not supply power from the power supply 19 to the inverter circuit 20. Therefore, the three phase signals are not supplied to the motor 2 though the microprocessor 33 supplies the rotation control signal indicative of the rotation of the rotor 1 and the rotation of the rotor 2 is protected or stopped.

When the switch 10 is not in the protection mode pursuant to the protection signal 11, power from the power supply 19 is supplied to the inverter circuit 20 through the switch 10. Then, the inverter control circuit 20 supplies the inverter signals to the photocouplers 28 and the three-phase drive signals are supplied to the motor 2 to rotate the rotor 1.

The microprocessor 33 has a clock input CLK1, a timer interruption input T1, event interruption inputs EV11 to EV13, A/D input AD2, and a reset input. A processing circuit including the microprocessor 33 has a clock circuit 34 for generating a first clock signal, a divider 36 for frequency dividing the first clock signal, a reset circuit 35 for resetting the microprocessor 33 by supplying a reset signal to the reset input, and a divider 37 for frequency dividing the first detection signal 15 and supplying the frequency divided first detection signal to the event interruption inputs EV11 to EV13. The microprocessor 38 has a clock input CLK2, a timer interruption input T2, event interruption inputs EV21 to EV23, A/D input AD1, and a reset input. A processing circuit 16 including the microprocessor 38 has a clock circuit 39 for generating a second clock signal, a divider 41 for frequency-dividing the first clock signal, a reset circuit 40 for resetting the microprocessor 38 by supplying a reset signal to the reset input, a divider 42 for frequency-dividing the first detection signal 15 and supplying the frequency divided first detection signal to the event interruption inputs EV21 to EV23.

Figure 3A:
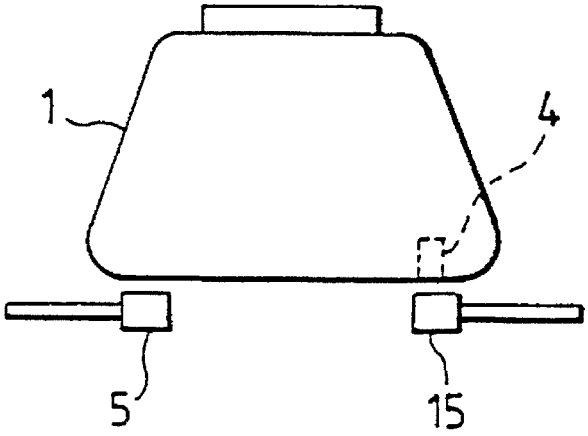
FIG. 3A is a side view of a rotor and first and second detectors shown in FIG. 1.
Figure 3B:
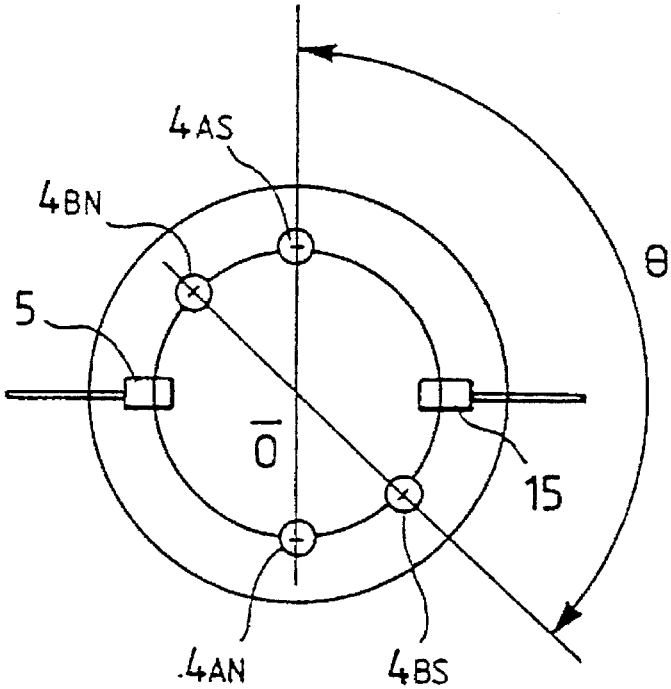
FIG. 3B is a bottom view of the rotor wherein the first and second detectors are also shown.

FIG. 3A is a side view of the rotor 1 and the first and second detectors 5 and 15 of this embodiment. FIG. 3B is a bottom view of the rotor and the first and second detectors are also shown. As shown in FIG. 3B, magnets 4AS and 4BS and balancers 4BN and 4AN are mounted on the bottom of the rotor 1 on the same circumference with a predetermined angle relation. More specifically, the magnets 4AS and 4BS generate magnetic fields showing S polarity to the first and second detectors 5 and 15 and located with a predetermined central angle θ with respect to a rotation axis of the rotor 1. On the other hand, the balancers 4AN and 4BN are located at counterbalance positions against the magnets 4AS and 4BS. That is, the balancers 4AN and 4BN are arranged at point symmetrical positions with respect to the magnets 4AS and 4BS.

In this embodiment, the first and second sensors 5 and 15 detect the passing of the magnets 4AS and the 4BS above the first and second sensors 5 and 15. However, it is also possible that the balancers 4AN and 4BN comprise magnets arranged to show N polarities against the first and second detector 5 and 15. Then, the first detector detects passing of the S polarity of a magnet fields from the magnets 4AS and 4BS. On the other hand, the second detector 15 detects the magnetic fields of N polarity. Such a structure provides detection of a defect in the first or second detection signal, a decrease in the magnetic force of the magnets, and a defect of a magnet. Thus, it is possible to take a appropriate action.

Figure 4:
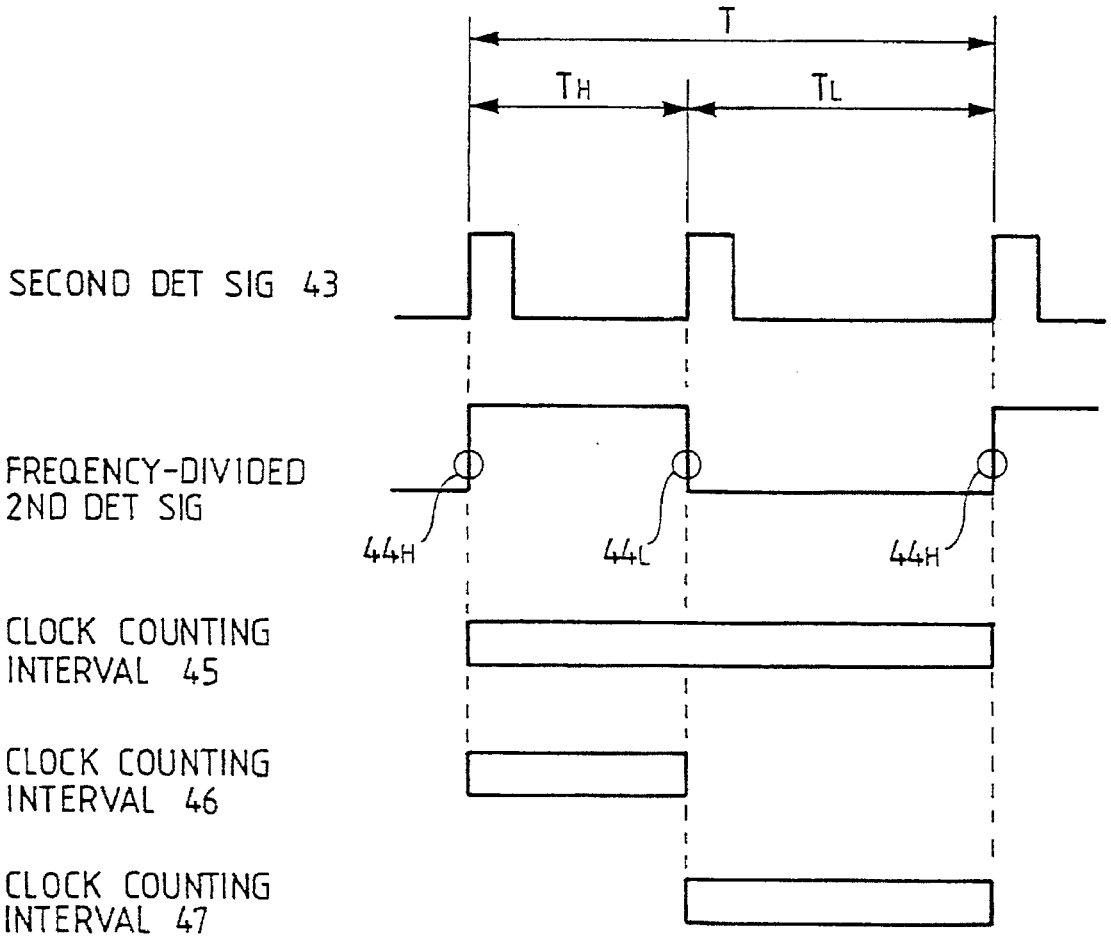
FIG. 4 is a graphic diagram of a time chart of this embodiment.
Figure 5:
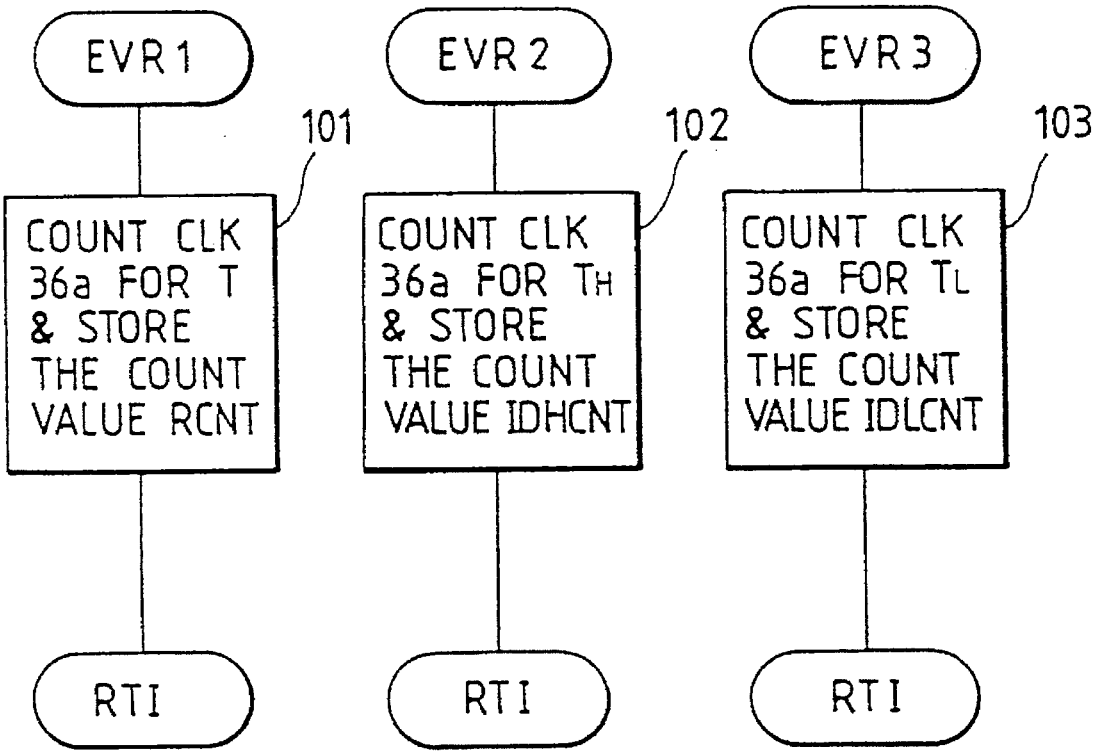
FIG. 5 depicts flow charts showing interruption operations.
Figure 6:
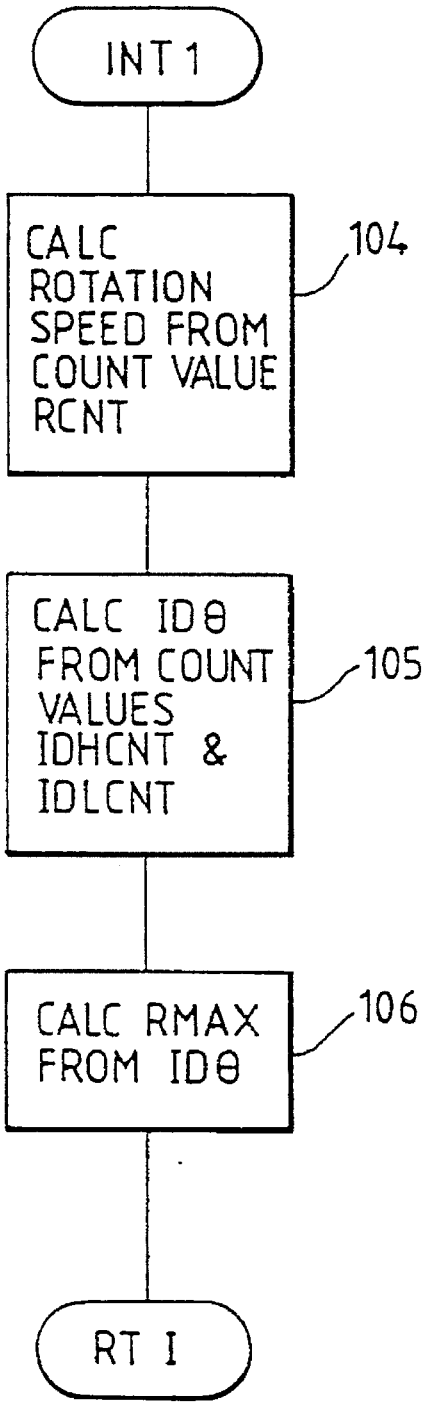
FIG. 6 depicts a flow chart showing a timer interruption operation.

FIG. 4 is a graphic diagram of a time chart of this embodiment. FIG. 5 depicts flow charts of interruption operations. When the motor 2 is supplied with the three-phase drive signals from the drive circuit 3, the motor 2 begins to rotate. Then, the second detector 15 generates the second detection signal 43. That is, the second detector 15 generates two pulses per one rotation interval T of the rotor 1. The divider 42 frequency-divides the second detection signal and supplies the frequency divided second detection signal 44 having the interval T to the event interruption input EV21 to EV23. In this embodiment, microprocessors M37451 (Mitsubishi Electric company) are used as the microprocessors 33 and 38. In that microprocessor, an event interruption EVR1 for measuring a pulse period is effected once per rotation of the rotor 1 at a rising edge 44H of the frequency-divided second detection signal 44. In response to the event interruption EVR1, an interruption processing 101 is executed. That is, the microprocessor 38 counts pulses (3 MHz, for example) in the divided clock signal 41*a* for the one rotation interval T, i.e., a clock counting interval 45, and the count value RCNT is stored in a memory (not shown) included in the microprocessor 38. Similarly, an event interruption EVR2 for measuring a period $T_H$ is effected once per rotation of the rotor 1 at a rising edge 44H of the frequency-divided second detection signal 44 and finishes at the falling edge 44L of the frequency divided second detection signal. In response to the event interruption EVR2, an interruption processing 102 is executed. That is, the microprocessor 38 counts pulses in the divided clock signal 41*a* for an interval $T_H$ where the frequency-divided second detection signal is H, i.e., for a clock counting interval 46, and the count value IDHCNT is stored in the memory included in the microprocessor 38. Moreover, an event interruption EVR3 for measuring a period $T_L$ is effected once per rotation of the rotor 1 at a falling edge 44L of the frequency-divided second detection signal 44 and finishes at the rising edge 44H of the frequency divided second detection signal. In response to the event interruption EVR3, an interruption processing 103 is executed. That is, the microprocessor 38 counts pulses in the divided clock signal 41*a* for the period $T_L$ where the frequency-divided second detection signal is L, i.e., for a clock counting interval 47, and the count value IDLCNT is stored in a memory included in the microprocessor 38. The divider 41 supplies the frequency-divided clock signal 41 having a period of about 100 msec to the timer interruption input T2 of the microprocessor 38. FIG. 6 depicts a flow chart of a timer interruption operation. This timer interruption operation INT1 is executed every 100 msec.

In step 104, the microprocessor 38 calculates an actual rotation speed RRPM of the rotor 1 from the count value RCNT in accordance with the following equation:

$$RRPM=(60\times3\times10^5)/\text{count value } RCNT\ [\text{min}^{-1}] \quad (1)$$

Then, the microprocessor 38 stores the actual rotation speed RRPM in the memory thereof. In the following step 105, the microprocessor 38 calculates a kind code iDθ of the rotor 1 from the count values IDHCNT and IDLCNT in accordance with the following equation:

$$ID\theta=(IDHCNT)/(IDHCNT+IDLCNT)\times360^\circ \text{ (when } IDHCNT\leqq IDLCNT) \quad (2)$$

$$ID\theta=(IDLCNT)/(IDHCNT+IDLCNT)\times360^\circ \text{ (when } IDHCNT>IDLCNT) \quad (3)$$

In the following step 106, the microprocessor 38 calculates an allowable maximum rotation speed RMAX in accordance with the following equation:

$$RMAX=k\times ID\theta[/\text{min}] \quad (4)$$

where k is a constant.

Figure 7:
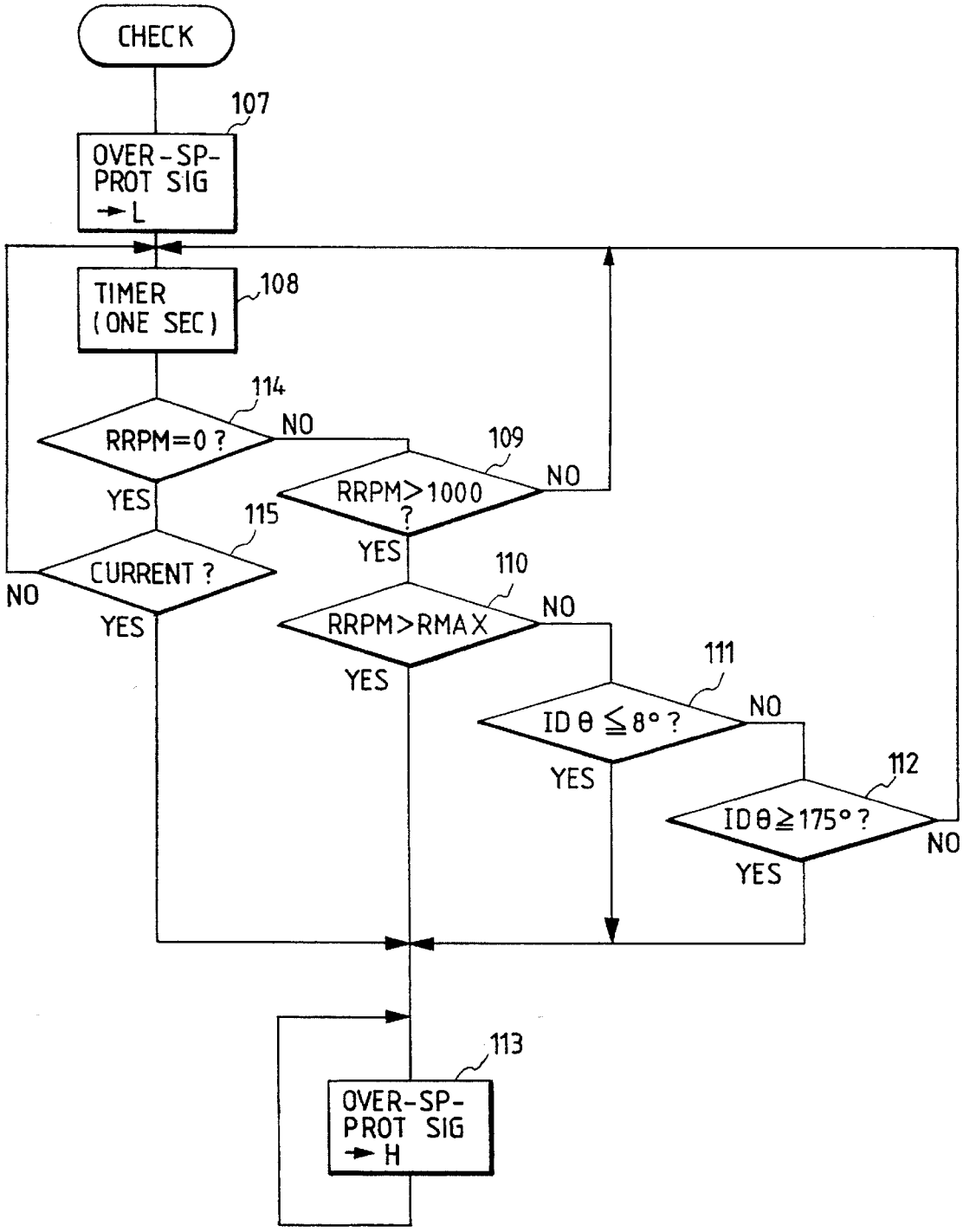
FIG. 7 depicts a flow chart showing this embodiment showing a check processing for the protection operation.

FIG. 7 depicts a flow chart of this embodiment wherein a check processing for the protection operation is provided. This processing is executed in response to an initializing operation following a power ON of this apparatus. In step 107, the microprocessor 38 makes the protection signal 18 L (logic low level). Then, it is possible to start to rotate the rotor 1. In this state, when an operator operates the operation portion 6 to command the rotation of the rotor 1, the rotor 1 begins to rotate in accordance with other operation programs (not shown). In the following step 108, the microprocessor 38 waits for one second. In the following step 114, the microprocessor 38 determines whether the rotation speed RRPM is zero. If the rotation speed RRPM is not zero, processing proceeds to step 109. In the step 109, the microprocessor 38 determines whether the rotation speed RRPM is larger than 1000 rpm. If the rotation speed RRPM is not larger than 1000 rpm, processing returns to step 108. That is, if the rotation speed is less than 1000 rpm, this centrifugal apparatus may be in the condition of exchanging of rotor 1, in a power fail, or the like, whereby the processing for the protection is not effected. If the rotation speed RRPM is larger than 1000 rpm, the microprocessor 38 determines, in step 110, whether the rotation speed RRPM is larger than the allowable maximum rotation speed RMAX. If the rotation speed RRPM is larger than the allowable maximum rotation speed RMAX, the microprocessor raises the protection signal to 18 H (logic high level) in step 113. Therefore, if the rotation speed RRPM is larger than 1000 rpm and the allowable maximum rotation speed RMAX, the microprocessor 38 stops the rotation of the rotor 1 using the switch 17.

In step 110, when the rotation speed RRPM is not larger than the allowable maximum rotation speed RMAX, the microprocessor 38 determines whether ID$\theta\leqq8^\circ$ in step 111. If ID$\theta\leqq8^\circ$, the microprocessor 38 determines that the kind code is incorrectly detected, that is, there is an abnormal state, such as a defects in the magnet 4AS or 4BS. Then, the microprocessor 38 raises the protection signal H to thereby stop the rotor 1 in step 113. Similarly, if ID$\theta>8^\circ$, the microprocessor determines whether ID$\theta\geqq175^\circ$. If ID$\theta<175^\circ$, processing returns to step 108 because this condition is determined to be a normal condition. If ID$\theta\geqq175^\circ$, the microprocessor 38 determines that the kind code is incorrectly detected, that is, there is an abnormal state. Then, the microprocessor 38 raises the protection signal 18 H to thereby stop the rotor 1 in step 113.

Once the processing of step 113 is executed. The processing loops there. Therefore, the protection is maintained until power to the apparatus is turned off. When this apparatus is powered on again, the reset circuits 35 and 40 detect this and the microprocessors 33 restarts this program after the initializing operation such as setting of the timer interruption, event interruptions, and clearing of the memory and setting variables. That is, the switch circuit 17 keeps this stop condition until a reset signal is inputted.

In the processing of step 112, if either of the magnet 4AS or 4BS detaches from the rotor 1 or if the detection signal which should be outputted twice per rotation of the rotor 1 is outputted once per rotation of the rotor 1 due to a decrease in the sensitivity of the magnetic field of either of the magnets 4AS or 4BS, the frequency divided detection signal has a duty ratio of 50%. Then, the calculated ID$\theta$ may be a value near 180°. Similarly, if ID$\theta$ is less than 8°, it is considered that there is some trouble in the detection of the magnet 4AS or 4AB. Therefore, the defect in either of the magnet 4AS or 4AB can be detected by steps 111 or 112. That is, the kind code is incorrectly detected.

In step 114, if the rotation speed RRPM is zero, that is the rotor 1 is stopped, processing proceeds to step 115. In step 115, the microprocessor 38 a/d converts the drive current detection signal from the drive current detector 50 and compares the drive current detection signal with a reference value to determine whether or not the drive signal is supplied to the drive line 14A. If the drive signal is supplied to the drive line 14A, processing proceeds to step 113 and the microprocessor 38 generates the protection signal 18. Then, the switch 17A stops supplying supply power from the power supply 30 to the photocouplers, so that the drive signals are not supplied to the motor 2. This condition occurs when the detection signal 15 is not generated though the rotor 1 is rotating because both magnets 4As and 4BS are detached from the rotor 1 or a sensitivity of the second sensor is too low to both magnets 4AS and 4BS.

In step 115, the microprocessor 38 compares a magnitude of the current detection signal with a predetermined value. If there is no current in the drive line 14A, that is, the drive signal is not, in fact supplied, processing returns to step 108. This condition occurs when the motor 2 is not supplied with the drive signals and stops in a normal condition. The above-mentioned operation is provided to surely protect the centrifugal apparatus of this embodiment by supplying no drive signals when the rotor stops. To provide even further protection, the drive signal current detection circuit 51 is provided to detect the drive signal on the drive line 14B and supply the drive signal current detection signal to the microprocessor 33 independently. The microprocessor 33 executes a check program (not shown) corresponding to the check program shown in FIG. 7 and generates the protection signal 9 independently when an overspeed condition occurs or the drive currents are supplied when the rotor should be stopped. These protection operations are performed independently and drive signal cut-off is effected in series, resulting in more dependable protection.

In this embodiment, the drive signals are generated by the processing circuit 8. However, it is also possible to generate the drive signals by the processing circuit 16 in response to the second detection signal from the detector 15 and an operation from the operation portion 6.

Figure 8:
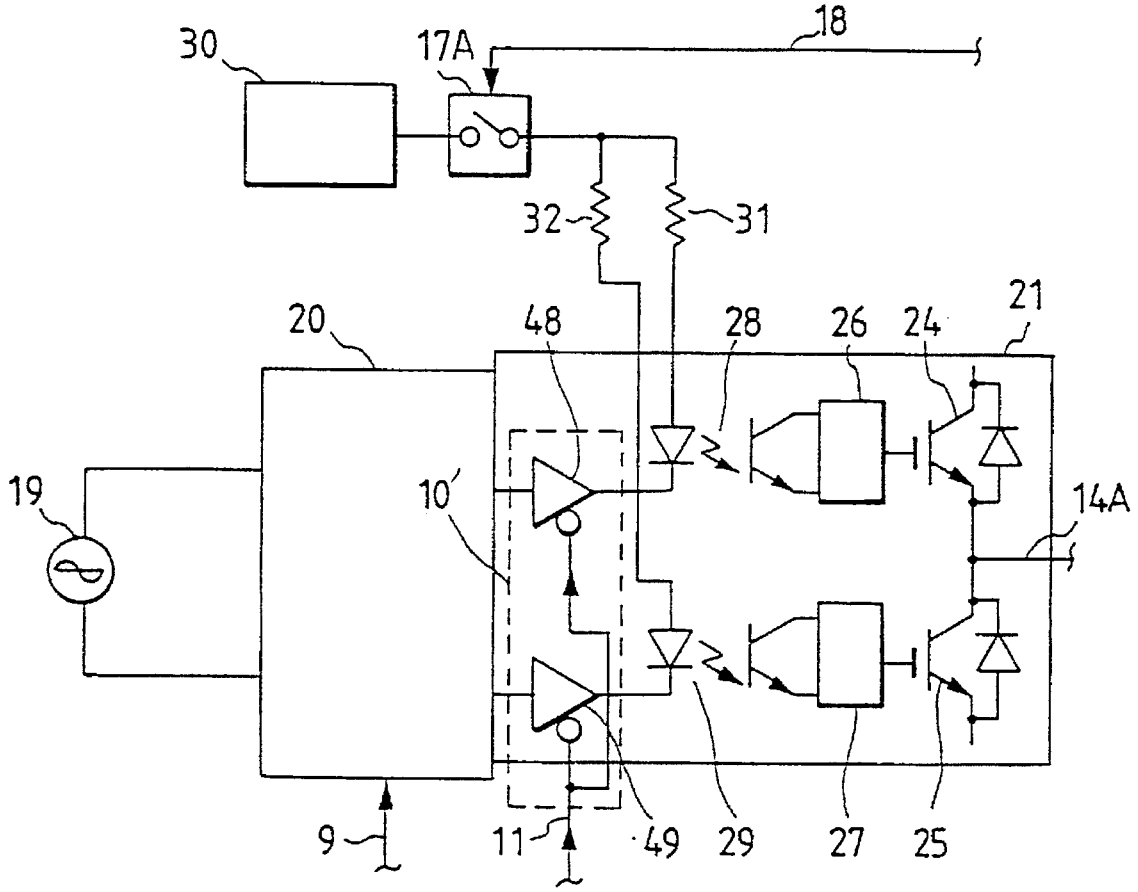
FIG. 8 is a partial block diagram of a modification of the centrifugal apparatus with protection.
Figure 9:
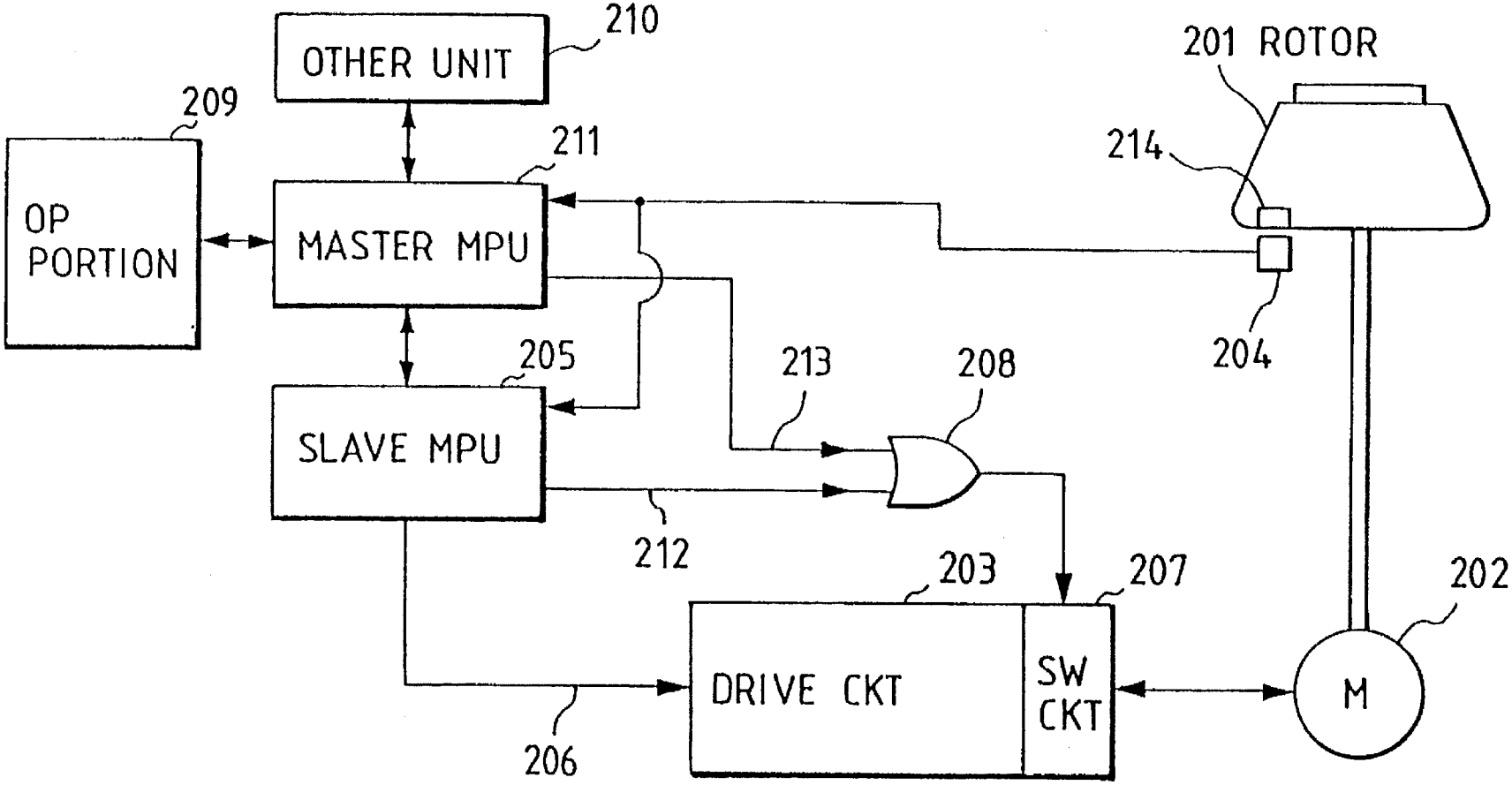
FIG. 9 PRIOR ART
FIG. 9 is a bock diagram of a prior art centrifugal apparatus with protection.

FIG. 8 is a partial block diagram of a modification of the centrifugal apparatus with protection according to the present invention. The basic structure is similar to the centrifugal apparatus shown in FIGS. 1 and 2. The difference is that the switch circuit 10' comprises tristate buffer driver circuits 48 and 49. The tristate gate buffer driver circuits 48 and 49 are set in a high impedance condition in response to the logic H level of the protection signal 11. Then, the rotation of the rotor 1 is stopped. The microprocessor 33 also detects the kind code and the actual rotation speed from the detector 5 and generates the protection signal 11 similarly. Therefore, the detection of the actual speeds and the kind codes are effected and the protection signals 11 and 18 are generated independently and substantially at the same time. Moreover, the switch circuit 10' responsive to the protection signal 11 and the switch circuit 17 responsive to the protection signal 18 operate independently but in series, so that dependable protection is provided against a single failure in this centrifugal apparatus.

In this embodiment, the feedback for protection of the rotor is doubled by providing the two magnets 4AS and 4BS, detectors 5 and 15, microprocessors 33 and 38, and switch circuits 10 and 17. Similarly, the feedback for the protection of the rotor 1 may be tripled by providing a third detector, a third processor and a third switch circuit connected in series.

In this embodiment, the kind of the rotor 1 and the rotation speed are detected through magnetic fields. However, the kind of rotor 1 and rotation speed may be detected optically or by using ultra-sonic waves or electromagnetic waves. Moreover, the indexes provided to the rotor in place of the magnets 4AS and 4BS may be modified in number, or the central angle of the mounted indexes. Moreover, a complicated pattern of the marker may be used with a magnetic recording medium or an optical recording medium.

What is claimed is:

1. A centrifugal apparatus comprising:

a rotor having marker means;

a motor responsive to drive signals for rotating said rotor;

first detection means for detecting said marker means upon rotation of said rotor and generating a first detection signal;

second detection means for detecting said marker means upon said rotation of said rotor and generating a second detection signal;

an input terminal for receiving a supply power;

a drive circuit for selectively generating said drive signals from said supply power;

first and second switch circuits for controlling application of said drive signals to said motor, said first and second switch circuits being connected in series via said drive circuit between said input terminal and said motor;

current detection means for detecting a current of one of said drive signals and generating a current detection signal;

first judging means for detecting whether said first detection signal is generated within a predetermined value and for operating said first switch circuit to cut-off said drive signals to said motor when said first detection signal is not generated within said predetermined value; and second judging means, for detecting whether said second detection signal is generated within said predetermined value, for operating said second switch circuit to cut-off said drive signals to said motor when said second detection signal is not generated within said predetermined value, for comparing a magnitude of said current detection signal with a first predetermined level, for detecting whether said second detection signal indicates that said rotor is stopped, and for operating said second switch circuit to cut-off said drive signals to said motor when said magnitude of said current detection signal is larger than said first predetermined level when said second detection signal indicates that said rotor is stopped.

2. The centrifugal apparatus of claim 1, further comprising second current detection means for detecting another one of said drive signals and supplying a second current detection signal to said first judging means, wherein said first judging means compares a magnitude of said second current detection signal with a second predetermined level, detects whether said first detection signal indicates that said rotor is stopped, and operates said first switch circuit to cut-off said drive signals to said motor when said magnitude of said second current detection signal is greater than said first predetermined level when said first detection signal indicates that said rotor is stopped, said first and second judging means operate independently of each other, and said current detection means and second current detection means operate independently of each other.

3. The centrifugal apparatus of claim 1, wherein said first and second judging means independently detect first and second rotation speeds from said first and second detection signals respectively, said first and second judging means independently detect whether said first rotation speed exceeds a predetermined value and whether said second rotation speed exceeds said predetermined value respectively, said first judging means controls said first switch circuit to cut-off said drive signals to said motor when said first rotation speed exceeds said predetermined value, and said second judging means controls said second switch circuit to cut-off said drive signals to said motor when said second rotation speed exceeds said predetermined value.

4. The centrifugal apparatus of claim 1, wherein said rotor is detachable from said motor and said marker means provides information indicative of the type of rotor, said first and second judging means further detect said information from said first and second detection signals respectively and determine first and second maximum rotation speeds in accordance with said detected information respectively, said first judging means operates said first switch circuit to cut-off said drive signals to said motor when said first rotation speed exceeds said first maximum rotation speed, and said second judging means operates said second switch circuit to cut-off said drive signals to said motor when a second rotation speed exceeds said second maximum rotation speed.

5. The centrifugal apparatus of claim 1, wherein said marker means comprises at least a magnet.

6. The centrifugal apparatus of claim 1, wherein said drive circuit comprises an inverter circuit for generating phase signals and a power bridge circuit for generating said drive signals from said phase signals, and said first switch circuit is provided between said input terminal and said inverter circuit.

7. The centrifugal apparatus of claim 6, wherein said second switch circuit comprises photocouplers for transmitting said phase signals to said power bridge circuit, a switch, and a power source for supplying a power to said photocouplers through said switch, and said second judging means controls said second switch circuit to cut-off said drive signals to said motor when said second detection signal is not generated within said predetermined value.

8. The centrifugal apparatus of claim 1, wherein said first and second judging means operate independently of each other.

9. A centrifugal apparatus comprising:

a rotor having marker means;

a motor responsive to drive signals for rotating said rotor;

detection means for detecting said marker means upon rotation of said rotor and generating a detection signal;

an input terminal for receiving a supply power;

a drive circuit for selectively generating said drive signals from said supply power;

a switch circuit for controlling application of said drive signals to said motor, said switch circuit being connected in series from said input terminal to said motor via said drive circuit;

current detection means for detecting a current of one of said drive signals and generating a current detection signal;

magnitude detection means for detecting a magnitude of said current detection signal; and judging means, for detecting whether said current detection signal is within a predetermined level, for detecting whether said detection signal indicates, based on said magnitude of said current detection signal, that said rotor is stopped, and for operating said switch circuit to cut-off said drive signals to said motor when said current detection signal is greater than said predetermined level when said current detection signal indicates, based on said magnitude of said current detection signal, that said rotor is stopped.

* * * * *